US009169682B2

(12) United States Patent
Reynard

(10) Patent No.: US 9,169,682 B2
(45) Date of Patent: Oct. 27, 2015

(54) LOCKING HINGE ASSEMBLY

(76) Inventor: Kenneth Reynard, North Yorkshire (GB)

( * ) Notice: Subject to any disclaimer, the term of this patent is extended or adjusted under 35 U.S.C. 154(b) by 0 days.

(21) Appl. No.: 13/511,589

(22) PCT Filed: Nov. 23, 2010

(86) PCT No.: PCT/GB2010/051948

§ 371 (c)(1),
(2), (4) Date: May 23, 2012

(87) PCT Pub. No.: WO2011/061551

PCT Pub. Date: May 26, 2011

(65) Prior Publication Data

US 2012/0233815 A1 Sep. 20, 2012

(30) Foreign Application Priority Data

Nov. 23, 2009 (GB) ..... 0920441.3

(51) Int. Cl.

| | |
|---|---|
| ***E05D 11/10*** | (2006.01) |
| ***B65D 88/12*** | (2006.01) |
| ***B65D 88/52*** | (2006.01) |

(52) U.S. Cl.

CPC ..... *E05D 11/1007* (2013.01); *B65D 88/129* (2013.01); *B65D 88/522* (2013.01); *E05D 11/10* (2013.01); *E05Y 2900/604* (2013.01); *Y10T 16/54052* (2015.01)

(58) Field of Classification Search

CPC ... E05D 7/1061; E05D 11/10; E05D 11/1007; E05D 11/1014; E05D 2015/1026; B65D 88/522; B65D 88/129

USPC ..... 16/231, 319, 355, 388, 232; 182/113, 182/63.1, 223

See application file for complete search history.

(56) References Cited

U.S. PATENT DOCUMENTS

| | | | | |
|---|---|---|---|---|
| 5,530,992 | A * | 7/1996 | Baermann | 16/231 |
| D374,391 | S * | 10/1996 | Mele | D8/323 |
| 6,247,744 | B1 * | 6/2001 | Townsend et al. | 296/146.11 |
| 6,523,223 | B2 * | 2/2003 | Wang | 16/324 |
| 6,588,323 | B1 * | 7/2003 | Cheng | 99/337 |
| 7,814,621 | B1 * | 10/2010 | Radke | 16/335 |
| 8,453,304 | B2 * | 6/2013 | Kunz | 29/33 R |
| 2004/0040784 | A1 * | 3/2004 | Johnson | 182/113 |
| 2004/0084249 | A1 * | 5/2004 | Rawlings et al. | 182/223 |
| 2009/0280971 | A1 * | 11/2009 | Kunz | 483/3 |

FOREIGN PATENT DOCUMENTS

| | | | |
|---|---|---|---|
| CN | 1014050202 | A | 4/2009 |
| GB | 191315399 | A | 0/1914 |
| GB | 2389773 | A | 12/2003 |

OTHER PUBLICATIONS

International Search Report for Application No. PCT/GB2010/051948 dated Feb. 23, 2011, 3 pages.

* cited by examiner

*Primary Examiner* — Emily Morgan
(74) *Attorney, Agent, or Firm* — Howard & Howard Attorneys PLLC

(57) ABSTRACT

A hinge assembly for a transportable load carrying platform having a pivot mounting for attachment to a base frame and pivot arm for attachment to an end wall. Cooperative lock means are provided on the pivot mounting and pivot arm and configured to engage one another when the arm is pivoted towards the mounting. Once locked in position, the pivot arm and mounting cannot be pivotally separated.

11 Claims, 3 Drawing Sheets

LOCKING HINGE ASSEMBLY

RELATED APPLICATIONS

This application claims priority to and all the advantages of International Patent Application No. PCT/GB2010/051948, filed on Nov. 23, 2010, which claims priority to Great Britain Patent Application No. GB0920441.3, filed on Nov. 23, 2009.

This invention relates to a hinge assembly and in particular, although not exclusively, to a transportable load carrying platform having a base frame for supporting a load, at least a pair of end walls mounted at the base frame via one or more respective hinge assemblies configured to allow the end walls to pivot relative to the base frame.

A transportable load carrying platform of the type with which the invention is concerned is referred to generally in the art, namely the transport of freight, as a "folding end flat rack", and which have been made and used for many years for transport/shipping of heavy or irregular shaped cargo which cannot be loaded into a normal ISO shipping container. Usually, the load is lashed down to the base frame of the platform, and the platform is transported with the end walls in the operative position. The platform is capable of being handled readily in this manner, including transit to a dock, transfer to a ship and onward sailing to the port of destination, transfer again to a vehicle or rail wagon, and transit to final destination. Alternatively, the load can be transferred at the port to a suitable load carrier for final transport to the eventual destination. In either event, for the return empty journey of the platform, the end walls are folded downwardly to the inoperative positions, so that stacks of unloaded platforms or "racks" can be formed and locked together for transport as stacks of empty units forming standard ISO modules.

The end walls are usually pivotally mounted at the ends of the base frame, and are locked in their operative positions. The locking of the end walls in the operative positions usually is obtained by operation of "shoot bolts" or the like which are mounted on the base frame, a small distance only above the pivots on which the end walls are mounted, and which are slid into receiving holes provided in the end walls after the walls have been pivoted upwardly through approximately 90° from the inoperative positions.

Given that the loads are usually lashed down firmly to the base frame, so that the loads will not normally be liable to move along the base frame in use, the end walls are unlikely to be exposed to any impact from the load during transport, and therefore the fact that only a small resisting moment is available to prevent pivoting of the end walls from the operative positions (because of the close spacing of the shoot bolts above the pivots) it is not generally a problem as far as the load is concerned. However, in the event of rough handling of the loaded platform, and/or when it is loaded on a ship adjacent to other loaded platforms during stormy weather, there is a risk of impacts being applied to the end walls and possible failure, or progressive damage being done to the shoot bolt locking of the end walls.

For this reason, it is necessary for regular inspection, and maintenance be carried out of the platforms. This is a substantial labour and material cost burden to be bourne by users of existing types of load carrying platforms (racks).

The invention addresses this problem, and seeks to provide an improved hinge assembly for mounting an end wall at one end of a base frame of a load carrying platform, and which is simple to operate and yet provides significantly greater resistance to damage in the event of impact being applied to the end wall.

The hinge assemblies of the present invention are positioned between the end walls and the base frame, according to specific implementations. The end walls are adjustable between operative positions in which the end walls extend upwardly from the base frame when a load is being supported by the base frame so that the loaded platform can be transported with the end walls in the operative position, and inoperative positions in which the end walls extend generally parallel to the base frame so as to reduce the overall height of the platform and thereby enable the unloaded platform to be stacked with other unloaded platforms to form a transportable stack of unloaded platforms.

According to a first aspect of the present invention there is provided a hinge assembly comprising: a pivot mounting suitable for attachment to a base frame; a pivot arm suitable for attachment to an end wall; pivot means configured to couple said pivot mounting and said pivot arm wherein said pivot arm is capable of pivoting relative to said pivot mounting; cooperating lock means provided on said mounting and said arm and configured to engage when said arm is pivoted towards said mounting; said lock means having a male and female element wherein said male element is capable of rotation when located at least partially within said female element to lock said pivoting arm at said mounting to prevent further pivoting movement of said arm.

Preferably, the female element comprises a recess or channel like groove formed at an outer edge of said mounting. More preferably, the channel like groove comprises a cross section defining an arc extending over a range 200-300° and preferably 250-270°.

The male element preferably comprises a cylinder that is rotatable within the recessed female lock element. Preferably, the cylindrical male lock element comprises a cut-out section extending over a region along the length of the cylinder. The cut-out section may be considered a semi-cylindrical section bordered at each end of its length by short full cylindrical sections.

Alternatively, the male lock element may comprise any form of rod or shaft configured to be accommodated within the recessed female lock element such that the male element is capable of rotation, including partial rotation, within the female element when the pivot arm is aligned with the pivot mounting.

Preferably, the male lock element is rotatably mounted at said swing arm and projects outwardly from both sides of said pivot arm in a plane aligned substantially parallel with the pivoting axis of said pivot means. Alternatively, the male lock element may be configured to sit flush with one or both sides of the pivot arm so as to be co-planar with one or both faces of the pivot arm.

Preferably, the hinge assembly further comprises a handle removeably attachable to said male lock element and configured to allow a user to rotate said male lock element when located within said female lock element. The male lock element may comprise a keyhole or specifically profiled recess to receive a corresponding male key element optionally forming part of the handle. Once the key element has been inserted within the keyhole or recess the male lock element may be rotated within the female element.

Preferably, the male lock element is configured such that when the pivot arm is pivoted to be positioned behind the pivot mounting such that the male lock element is engaged within the female lock element, an exposed end of the male lock element is positioned substantially coplanar with the exposed planar surface of the pivot mounting. This configuration avoids undesired rotation of the male lock element so as to unlock it within the female recess and allow the pivot arm to be pivoted relative to the mounting and accordingly the end wall pivoted relative to the base frame.

According to a second aspect of the present invention there is provided a transportable load carrying platform comprising a hinge assembly having: a pivot mounting suitable for attachment to a base frame; a pivot arm suitable for attachment to an end wall; pivot means configured to couple said pivot mounting and said pivot arm wherein said pivot arm is capable of pivoting relative to said pivot mounting; cooperating lock means provided on said mounting and said arm and configured to engage when said arm is pivoted towards said mounting; said lock means having a male and female element wherein said male element is capable of rotation when located at least partially within said female element to lock said pivoting arm at said mounting to prevent further pivoting movement of said arm.

The invention therefore provides a transportable load carrying platform, with a base frame and opposed end walls, in which at least one of the end walls can be simply manipulated, preferably manually or electronically, to be adjusted between an inoperative to an operative position.

A preferring embodiment of the hinge assembly according to the invention will now be described in detail, by way of example only, with reference to the accompanying drawings, in which:

FIGS. 1*a*, 1*b*, 1*c*, and 1*d* are, respectively, plan, side, front and rear elevation views of a load carrying platform within which the hinge assembly may be installed according to a specific implementation of the present invention;

Referring to FIGS. 1*a* to *d*, the load carrying platform 10, commonly referred to as a folding end flat rack within the art, comprises a base frame 11 for supporting a load (not shown), such load being a large piece of machinery, or irregular cargo, not capable of being shipped in a standard ISO container. The load will normally be lashed down firmly to the base frame 11.

Figure 1A:
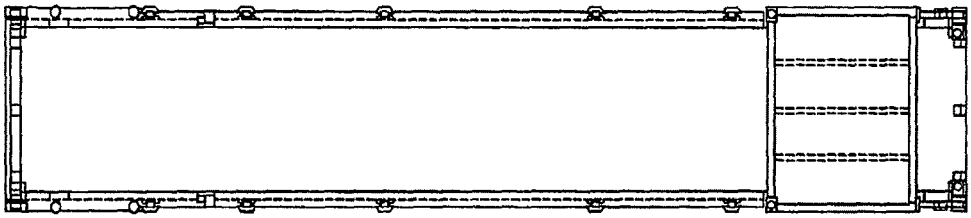
Figure 1B:
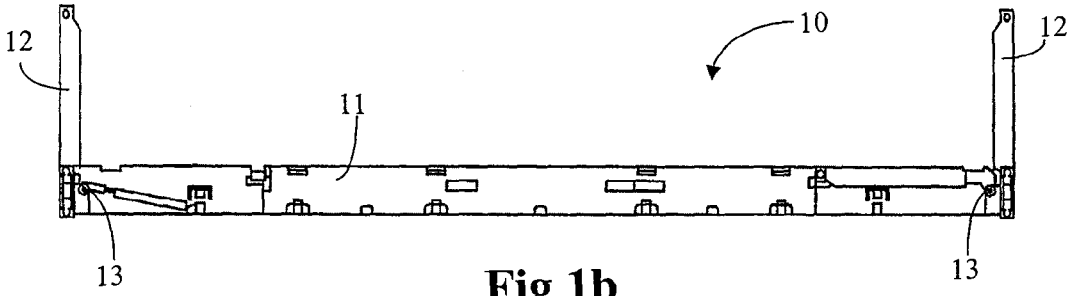
Figure 1C:
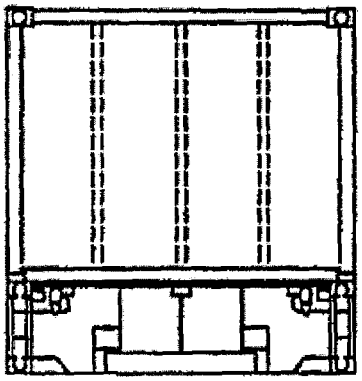
Figure 1D:
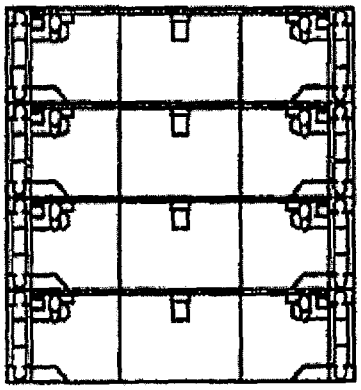

A pair of end walls 12 are mounted one at each of two opposed ends of the base frame 11, such end walls being adjustable between operative positions shown in FIG. 1*b*, in which the walls extend upwardly from the base frame 11 when a load is being supported by the base frame, so that the loaded platform 10 can be transported with the end walls locked in the operative positions.

The end walls 12 can also take up inoperative positions, as shown for the right hand end wall 12 in FIGS. 1*a* and 1*b*, in which the end walls 12 extend generally parallel to, and overlie the base frame 11, so as to reduce the overall height of the platform 10 and thereby enable the unloaded platform to be stacked with other unloaded platforms to form a transportable stack of unloaded platforms for the return journey.

The end walls 12 can pivot upwardly and downwardly about hinge assemblies 13, and when they reach the upwardly extending operative position, after pivoting through approximately 90°, the end walls 12 are then locked in position by suitable lock means, described in detail below, serving to positionally lock the pivoting components of the hinge assembly to prevent further pivoting and hence upward and downward movement of end walls 12 relative to base frame 11.

Figure 2:
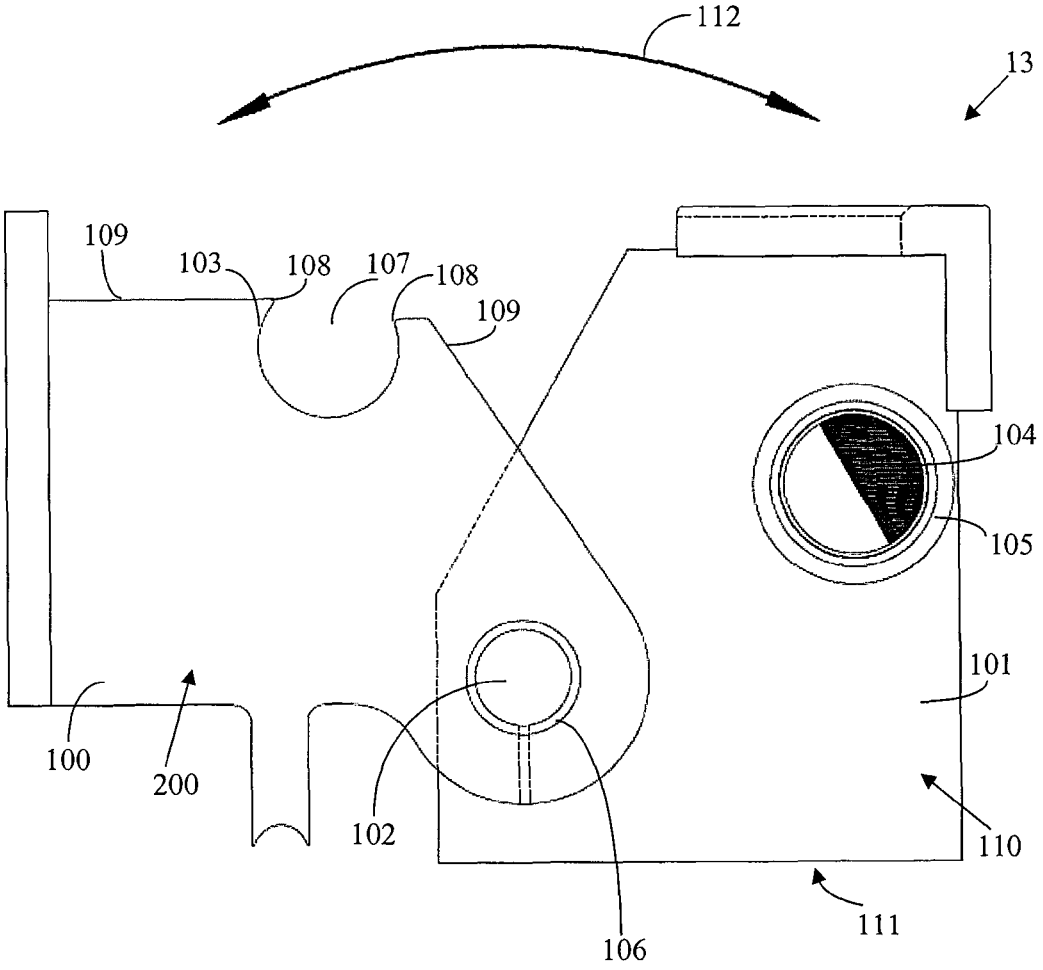
FIG. 2 is a plan view of the pivot mounting and pivot arm including male and female lock elements in an unengaged position according to a specific implementation of the present invention.

FIG. 2 illustrates a plan view of the hinge assembly 13 in which a swing arm 101 is pivotally mounted at a pivot mounting 100 via a pivot 102. Pivot 102 couples arm 101 and mounting 100 in pivoting relationship. Pivot 102 comprises a pivot pin located within a suitable housing 106 whereby the pivoting axis is aligned substantially perpendicular to the plane of movement of arm 101 relative to mounting 100.

Mounting 100 comprises a female lock element formed as a recessed portion 103 provided at a perimeter of mounting 100 at a leading edge 109. Recessed portion 103 is formed as a substantially cylindrical-like cavity in which the perimeter of the cavity, through a cross section, defines an arc of a circle extending over 250-270°.

The open end of the recess defines a mouth 107 bordered by shoulders 108 formed at the junction between the internally projecting cavity 103 and leading edge 109 of mounting 100.

Figure 4:
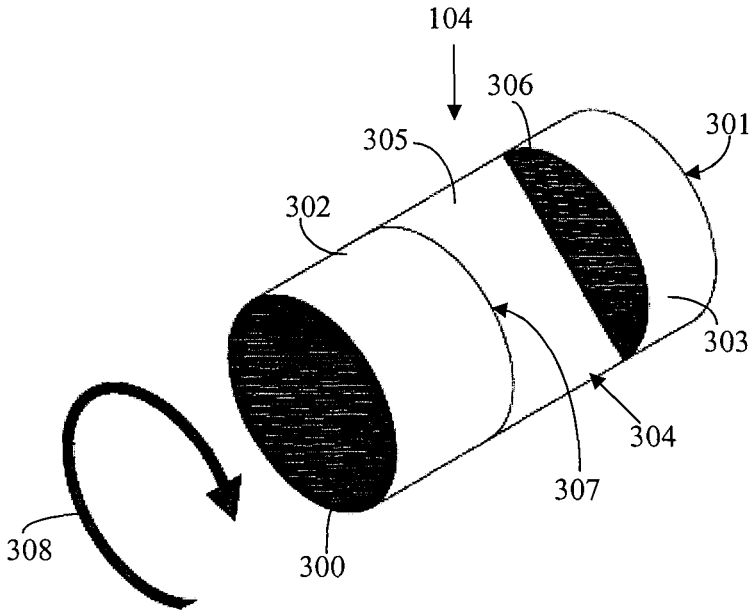
FIG. 4 is a perspective view of the male lock element as illustrated in FIGS. 2 and 3.

Pivoting arm 101 comprises a male lock element 104 illustrated further in FIG. 4. The cylindrical male lock element is rotatably mounted within a suitable housing 105 and extends substantially perpendicular to the plane of the plate-like (substantially planar) pivot arm 101. In particular, male lock element 104 extends substantially perpendicular to an upward facing surface 110 and a downward facing surface 111 of arm 101 and aligned substantially parallel with the pivot axis of pivot 102. Via pivot 102, arm 101 is configured to pivot relative to mounting 100 as indicated by arrow 112.

Figure 3:
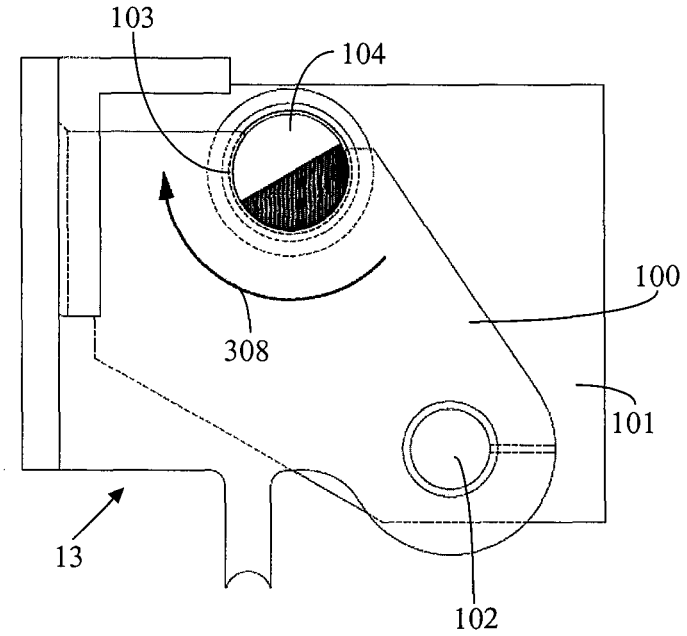
FIG. 3 is a plan view of the hinge assembly of FIG. 2 in which the male and female lock elements are in an engaged, locked position.

FIG. 3 illustrates a plan view of the hinge assembly of FIG. 2 in a locked configuration and FIG. 4 is a perspective view of the male lock element 104 configured for rotation within recess 103. Referring to FIG. 3, when arm 101 is pivoted towards an overlapping position with the substantially planar mounting 100, the male lock mounting 105 is aligned coaxially with the cylindrical-like cavity that defines the female lock element 103. Mouth 107 comprises a width sufficient to admit the cylindrical male lock element 104 such that the main body (304) of cylinder 104 is received within the cylinder like cavity 103 and is free to rotate therein as indicated by arrow 308.

Male lock element 104 comprises a first end face 300 and second opposed end face 301. A first cylindrical portion 302 extends from end face 300 and a second cylindrical portion 303 extends from end face 301 with the cylindrical portions 302, 303 being divided by a cut-out region 304. The cut-out region extends over a region along the length of the cylindrical main body and is formed to a depth approximately equal to the radius at a cross section of the cylinder. Accordingly, cut-out region 304 is defined by a substantially planar face 305 bordered at each end by inward facing semi circular faces 306, 307. At region 304, the male lock element 104 comprises a substantially semi-cylindrical geometry.

According to specific embodiments, the male lock element 104 comprises means to engage with a handle (not shown) to enable the element 104 to be rotated by rotation of the handle. Such means may include for example at least one projection or cavity. Additionally, male element 104 may comprise edge profiling so as to be engaged by a correspondingly profiled handle. That is, cylindrical segments 302, 303 may comprise a polygonal cross sectional profile at an end region.

When the pivot arm 101 is rotated to overlap the mounting 100, the end face 300 of male element 104 is aligned to be coplanar with an upper face 200 of mounting 100. Alternatively, end face 300 may sit just below the plane of upper face 200 such that male element 104 cannot be grasped by a user and rotated without the use of a specific handle (not shown) or key element (not shown). That is, male element 104 does not project above the upper face 200 of mounting 100 according to the preferred embodiment.

To provide engagement of the locking means via cooperation between the male locking element 104 and female locking element 103 the cut-out region 304 is oriented such that it is received within recess 103 by sliding past/between shoulders 108. To lock the pivot arm in position at the mounting, a user rotates the male lock element 104 via the handle or locking key (not shown) releasably engaged at end face 300 of male lock element 104. Rotating cylinder 104 within recess 103 brings the plane of face 305 into a substantially parallel planar relationship with the plane extending between the opposed shoulders 108. As the cross sectional diameter of the male lock element 104 region 304 is greater than the distance between shoulders 108 such that element 104 is trapped within recess 103 whereby pivot arm 101 and end walls 12 are locked in position and prevented from pivoting relative to mounting 100 and base frame 11.

The present invention is designed to be manually operated involving a manual turning of male lock element 104 within female lock element 103. Further specific implementations include the electronic actuated movement of the locking mechanism using conventional components. Additionally, the electronically actuated locking mechanism may be controlled remotely using conventional components.

The present hinge assembly is suitable for mounting at the load carrying platform of FIGS. 1*a-d* between end walls 12 and base frame 11. The present hinge assembly is also suitable for pivotally coupling all manner of configurations in which a first member is movable relative to a second member.

The invention claimed is:

1. A transportable load carrying platform comprising:

a substantially flat base frame configured to support a heavy machinery load to be transported using the transportable load carrying platform;

a pair of end walls mounted one at each of the opposed ends of the base frame, the end walls being pivotally adjustable between an operative position in which the end walls extend perpendicularly from the base frame and an inoperative position in which the end walls extend generally parallel and overlie the base frame; and at least one hinge assembly pivotally mounting each of the respective end walls at the base frame, the hinge assembly comprising:

a pivot mounting attached to the base frame;

a pivot arm attached to a corresponding end wall;

a pivot pin configured to couple the pivot mounting and the pivot arm;

a female locking element including an arcuate recess formed within a perimeter edge of the pivot mounting; and a male locking element including a cylindrical male body rotatably mounted within the pivot arm, the male body having a cut-out region extending along a length of the male body, the cut-out region defined by a substantially planar face bordered at each end by inward facing surfaces, the male locking element distanced from the perimeter edge of the pivot mounting in the inoperative position and positioned within the arcuate recess and adjacent to the perimeter edge in the operative position;

wherein an open end of the recess represents a mouth defined between a pair of shoulders at the perimeter edge, a width of the mouth between the shoulders being greater than a cross-sectional depth of the cut-out region to admit the male body to be received within the recess; and wherein a cross-sectional diameter of the male body at the cut-out region is greater than the width of the mouth such that the male body may be rotated within the recess to align the diameter of the male body to be orientated between the shoulders such that the male body is trapped within the recess to lock the position of each pivot arm at each mounting and the respective end walls at the base frame.

2. The transportable load carrying platform as claimed in claim 1 wherein the recess comprises a cross section defining an arc extending over a range 200-300°.

3. The transportable load carrying platform as claimed in claim 1 wherein the recess comprises a cross section defining an arc extending over a range 250-270°.

4. The transportable load carrying platform as claimed in claim 1 wherein the cut-out region comprises a semi-cylindrical geometry.

5. The transportable load carrying platform as claimed in claim 1 wherein the male body is rotatably mounted at the pivot arm and projects outwardly from both sides of said pivot arm in a plane aligned substantially parallel with a pivoting axis of the pivot pin.

6. The transportable load carrying platform as claimed in claim 1 wherein the male body comprises a first cylindrical portion and a second cylindrical portion, the first and second cylindrical portions separated by the cut-out region.

7. The transportable load carrying platform as claimed in claim 6 wherein the cut-out region extends to a depth approximately equal to a radius of the first and second cylindrical portions.

8. The transportable load carrying platform as claimed in claim 1 comprising two hinge assemblies pivotally mounting each of the respective end walls at the base frame.

9. The transportable load carrying platform as claimed in claim 1, the male locking element being moved toward the female locking element as the pivot arm is moved from the inoperable position to the operable position.

10. The transportable load carrying platform as claimed in claim 1, the pivot arm being rotated through a 90° angle of rotation between the operable position and the inoperable position.

11. The transportable load carrying platform as claimed in claim 1, the male locking element including a first end face and an opposite second end face, the first end face being substantially flush with an outer surface of the pivot mounting with the pivot arm in the operable position.

* * * * *